US010689922B2

(12) United States Patent
Taraldrud et al.

(10) Patent No.: US 10,689,922 B2
(45) Date of Patent: Jun. 23, 2020

(54) SYSTEM AND METHOD FOR PROVIDING TENSION OR HEAVE COMPENSATION IN AN OFFSHORE DRILLING ENVIRONMENT

(71) Applicant: CASTOR DRILLING SOLUTION AS, Kristiansand S (NO)

(72) Inventors: Paal Anders Taraldrud, Tveit (NO); Øyvind Vaagland Reiten, Lillesand (NO); Christian Bertil Von Der Ohe, Kristiansand S (NO); Tommy Skibelid, Homborsund (NO); Øyvind Haugen, Kristiansand S (NO); Runar Birkeland, Mandal (NO)

(73) Assignee: CASTOR DRILLING SOLUTION AS, Kristiansand S (NO)

( * ) Notice: Subject to any disclaimer, the term of this patent is extended or adjusted under 35 U.S.C. 154(b) by 0 days.

(21) Appl. No.: 16/079,951

(22) PCT Filed: Feb. 24, 2017

(86) PCT No.: PCT/NO2017/050052
§ 371 (c)(1),
(2) Date: Aug. 24, 2018

(87) PCT Pub. No.: WO2017/146594
PCT Pub. Date: Aug. 31, 2017

(65) Prior Publication Data

US 2019/0071938 A1 Mar. 7, 2019

(30) Foreign Application Priority Data

Feb. 26, 2016 (NO) ..... 20160325

(51) Int. Cl.
*E21B 19/00* (2006.01)
*E21B 19/09* (2006.01)

(52) U.S. Cl.
CPC ..... *E21B 19/006* (2013.01); *E21B 19/008* (2013.01); *E21B 19/09* (2013.01)

(58) Field of Classification Search
CPC ..... E21B 19/006; E21B 19/008; E21B 19/09
See application file for complete search history.

(56) References Cited

U.S. PATENT DOCUMENTS 3,653,636 A 4/1972 Burrell
4,004,532 A * 1/1977 Reynolds ..... E21B 19/006 114/256

(Continued)

FOREIGN PATENT DOCUMENTS

WO WO 2014/209131 A1 12/2014
WO WO 2015/007412 A2 1/2015
WO WO 2015/189368 A2 12/2015

OTHER PUBLICATIONS

International Search Report issued in international Patent Application No. PCT/NO2017/050052 dated Jun. 27, 2017.

*Primary Examiner* — James G Sayre
(74) *Attorney, Agent, or Firm* — Arent Fox LLP

(57) ABSTRACT

A heave compensation and riser tensioning system and method for an offshore drilling or production operation. The system includes at least one motor assembly, wherein the motor assembly further includes at least one motor; a drum assembly bracket; at least one wire drum; and at least one wire rope. The at least one wire rope has a first end fixedly attached to the wire drum, and a second end fixedly attached to a riser tension ring. The at least one motor is coupled to the at least one wire drum via a gear assembly.

18 Claims, 18 Drawing Sheets

(56) References Cited

U.S. PATENT DOCUMENTS

| | | | | |
|---|---|---|---|---|
| 4,496,032 | A | 1/1985 | Sommer | |
| 4,612,993 | A * | 9/1986 | Moore | E21B 19/09 166/335 |
| 5,101,905 | A * | 4/1992 | Arlt | E21B 19/09 166/350 |
| 7,633,248 | B1 * | 12/2009 | Williams | E21B 19/006 318/150 |
| 2003/0111653 | A1 * | 6/2003 | Heinrichs | B66D 1/22 254/342 |
| 2006/0249719 | A1 * | 11/2006 | Lesko | B66D 1/12 254/342 |
| 2010/0050917 | A1 | 3/2010 | Von Der Ohe | |
| 2010/0314168 | A1 | 12/2010 | Williams | |
| 2013/0307444 | A1 | 11/2013 | Settemsdal | |
| 2014/0010596 | A1 * | 1/2014 | Wu | E21B 17/01 405/224.4 |
| 2014/0284108 | A1 | 9/2014 | Pendleton et al. | |
| 2015/0361736 | A1 * | 12/2015 | Bergan | E21B 19/09 414/803 |

* cited by examiner

SYSTEM AND METHOD FOR PROVIDING TENSION OR HEAVE COMPENSATION IN AN OFFSHORE DRILLING ENVIRONMENT

CROSS-REFERENCE TO RELATED APPLICATION

This application is a 35 U.S.C. 371 National Phase of PCT Application No. PCT/NO2017/050052 filed Feb. 24, 2017 which claims priority to NO Application No. 20160325 filed Feb. 26, 2016. The disclosure of these prior applications are hereby incorporated by reference herein in their entirety.

TECHNICAL FIELD

The present invention relates generally to a system, method and device for riser tension, guide line tension and/or heave compensation of drillstring or other downhole equipment in an offshore drilling or production environment. More specifically the present invention relates to a system for providing passive tension/compensation force on a riser or drillstring arranged between a subsea well and a Floating Offshore Drilling vessel, Well intervention vessel and/or production vessel. Other targets may comprise tension and/or heave compensation to wirelines, guideline, podline and/or coiled tubing.

BACKGROUND OF THE INVENTION

Traditionally, a marine riser is provided with a tension system connected to the riser. The purpose of the tensioner system is to carry the weight of the riser, provide additional tensioning force to the riser and absorbing movement between the vessel and the riser within a preset and defined tensioner variation. The tensioning system will thus provide passive compensation for heave movements (wave action) and tide variations. The tensioner may comprise linear actuators in the form of hydraulic cylinder-piston arrangements being either directly coupled between the riser and the rig, or coupled via wire ropes and wire-sheave arrangement such as in the form of a jigger winch. Such systems are often referred to as respectively DRT, DAT—Direct acting riser/tension system, or WLT/WRT/MRT—Wire Line Tension/Wire Riser Tensioner/Marine Riser Tensioner.

Both methods have drawbacks.

Similar needs are present in operation of a drillstring, guideline, podline, or other downhole equipment such as wireline and coiled tubing operations, where the mentioned systems are typical means to compensate for the supported load and tensioning needs.

One possible solution for hydraulic riser tensioners employ hydraulic cylinders as their active element where the end portion of the hydraulic cylinder that includes the fluid cylinder part of the hydraulic cylinder is often connected to the rig main support structure and/or a movable support frame, the support frame being fixed to the vessel. The hydraulic cylinders piston rod end portion is often connected to the riser. The piston rod of the hydraulic cylinder is exposed to the environment when outside the cylinder. It is well known that the piston rod is attacked by chloride ions from the marine environment and high cyclic mechanical forces from the wave action. In addition grit and other particles coming through the air adheres to the often wet piston rod. The result is corrosion and increased wear of the piston rod, bearings, and seals. Such arrangements must frequently be maintained, and normally being located under the drill floor makes this operation expensive and time demanding.

Similarly for a drillstring compensator system using cylinders mounted in the top of the derrick is cumbersome to maintain in such aloft location and represent a weight that gives high center of gravity of the vessel affecting the variable load capacity.

A tensioner system being based on wireline assemblies arranged around the drill floor and substructure using a wire-sheave arrangement actuated by hydraulic cylinders arranged on the drill floor often results in a congested moon pool/drill floor area. Wire ropes and sheaves limits the access to areas where other drilling operation activities are conducted, and such systems represents a security risk for the personnel working on the drill floor. Additionally the total weight distribution on the drilling/production vessel is vertically higher because of the top deck/drill floor vertical mounted hydraulic cylinders and wire sheaves. Space requirements of such systems, also in the height, represent a challenge on the drill floor. Additionally such systems are limited in maximum capacity from a practical point of view by wire rope and sheave diameters. These systems are also maintenance intensive. For example handling the wire rope while doing cut and slip operations is difficult, especially for the larger wire rope sizes.

Existing offshore tension and compensator systems are normally based on hydraulics, set up to work with air pressure reservoirs, such as primary Air Pressure Vessels, APVs, and stand-by APVs. The primary APVs is arranged to generate the continuous pressure in accumulators in the tensioning system, and since these accumulators work with a constant operating cylinder area, the pressure will always be the same for a given primary APVs pressure. This pressure may be changed by a decrease valve venting the primary APV pressure or by filling additional gas/air/nitrogen into the primary APVs using an increase valve. The additional gas may be sourced from stand-by APVs or directly from a compressor unit.

For emergency situations, such as when a string cut off/riser disconnect is activated, the traditional system must be dimensioned to provide additional lift force (over dimensioned) for enabling lift off of the riser from the well head. An overcapacity of between 20-70% tension forces is normally provided for such emergency operation. The stand-by APV resource may be used if a rapid change in the mud weight in the riser is required. A rise in required mud weight increases the weight of the riser requiring increased pressure in the primary APVs. For example for drillstring compensators the pressure is increased when drilling deeper as additional drill pipe stands are connected to the drillstring.

An offshore drilling or production rig may need to operate in fast changing and challenging conditions, and large heave movements may dictate the variations in load capacity the tension systems must be able to compensate.

A first objective technical problem with existing systems is how to overcome or minimize, due to exposure to the sea water and drilling/production environment, the vulnerability to corrosion, wear and fatigue of the riser tensioner system.

A second objective technical problem is how to construct a riser tensioning system or compensator system that occupies minimal space in the tower or near the drill floor and in the moonpool area.

A third objective technical problem is how to make a compensator and or tensioning system more flexible and less dependent on the hydraulic reservoir of the accumulators and the reserve gas reservoir.

A fourth objective technical problem is how to lower the center of gravity of a drilling/production platform.

It is an object of the invention to provide solutions to at least one of the objective technical problems stated above.

SUMMARY OF THE PRESENT INVENTION

The present invention provides a tensioning and compensator system for use in exploration/production of a subsea well from a Floating Offshore Drilling vessel, Well intervention vessel and/or production vessel, the system comprising a motor assembly for providing tension to a riser, drillstring or other downhole equipment, the motor assembly may be adapted for being arranged below the drill floor, and thus providing higher endurance, less maintenance, and lower center of gravity of the offshore vessel as well as occupying less floor space and less pressure reservoir volume compared to existing tension systems.

The present invention further provides a tension system and compensator system comprising one or more motor assemblies, each motor assembly comprising at least one motor, at least one wire rope and wire drum and optionally a wire sheave arrangement, where the complete assembly may be mounted to the underside of the drill floor. The wire rope is spooled on the drum in one end, and attached to the riser, drillstring or other downhole equipment, optionally via a tensioner ring in the other end or via travelling block and/or drawwork system. The motor is controlling the tension in the wire rope by being coupled with the drum via a gear/or mechanical drive assembly. The motor is further coupled to an energy reservoir.

The present invention can be arranged to provide heave compensation of any downhole or guideline/podline operation, for example a drill string operation, providing heave compensation to the drill string. Such an embodiment will typically move the heave compensator from a top mounted traditional crown block heave system to arranging a Digital Hydraulic and/or Electrical Motor Deadline/Winch Heave Compensator in the position of the traditional deadline anchor position.

The motor may be a hydraulic motor, conventional motor or an electric motor.

The energy reservoir may be a pneumatic reservoir, battery, capacitor, fly wheel, etc.

The hydraulic motor may be a digital cylinder/pump motor (digital motor) or a conventional motor.

A motor tensioner/compensator assembly controller is coupled to the motor assembly and controls the force supply to the motor assembly provided by a reservoir. The controller may additionally control each motor and even each piston in the individual motor in the case where the motor is a digital motor. Individual piston control enables a more flexible arrangement where the active piston area may be changed during operation as requirements to load tension/compensation changes. This may be caused by added load, mud weight, changing heave, tide changes, buoyancy, or even riser cutoff at well head, etc. A traditional top tension system must calculate a 20-70% security margin in tension, and the pressure reservoir must be correspondingly larger because of that the fixed area of the pistons in the cylinder assemblies needs to move a constant volume of pressure fluid. A system according to the present invention may be optimized for operation at a specified load, but may still react quickly when a need for more pull is required by simply activate more motor power, and in the case of the digital hydraulic motor: activate more pistons, for controlling the tensioning capacity to the riser, drillstring or other downhole equipment.

In the case of a hydraulic digital motor assembly, by activating more pistons in the digital motors, the total area of the cylinders increases, thus increasing the total displaced volume and hence the capacity of the tensioning/compensator system increases. Opposite when activating fewer pistons in the digital motors, the total area of the cylinders reduces, thus decreasing the total displaced volume, and hence the capacity of the tensioning/compensator system reduces. It is thus possible to design a system which requires less deck mounted/topside equipment to provide required tension/compensation capacity, and a system will much easier be customized for tasks with different load capacity requirements. The latter enabling more optimization of energy reservoir volume of equipment necessary to provide required over capacity.

The advantages with present invention are considerable in regards to fewer requirements to compressor capacity, flexibility of better customizing the equipment to the required task, and most importantly elimination of rig/vessel space occupancy.

It may further be provided a displaceable frame, a skidding/sliding device, providing a mounting platform for the motor tensioner assemblies. The displacement frames are mounted to the underside of the floor for enabling the riser tension system comprising a plurality of motor assemblies to be moved from one drilling center to another center, for example between the main drilling center/area and auxiliary center/area or the production center/area.

BRIEF DESCRIPTION OF THE DRAWINGS

Non limiting embodiments will be described with references to the figures. The invention now to be described further with reference to the drawings, showing non-limiting examples of the invention, comprises:

FIG. 2A—FIG. 1 from a side view

DETAILED DESCRIPTION OF EMBODIMENTS OF THE INVENTION

Figure 1:
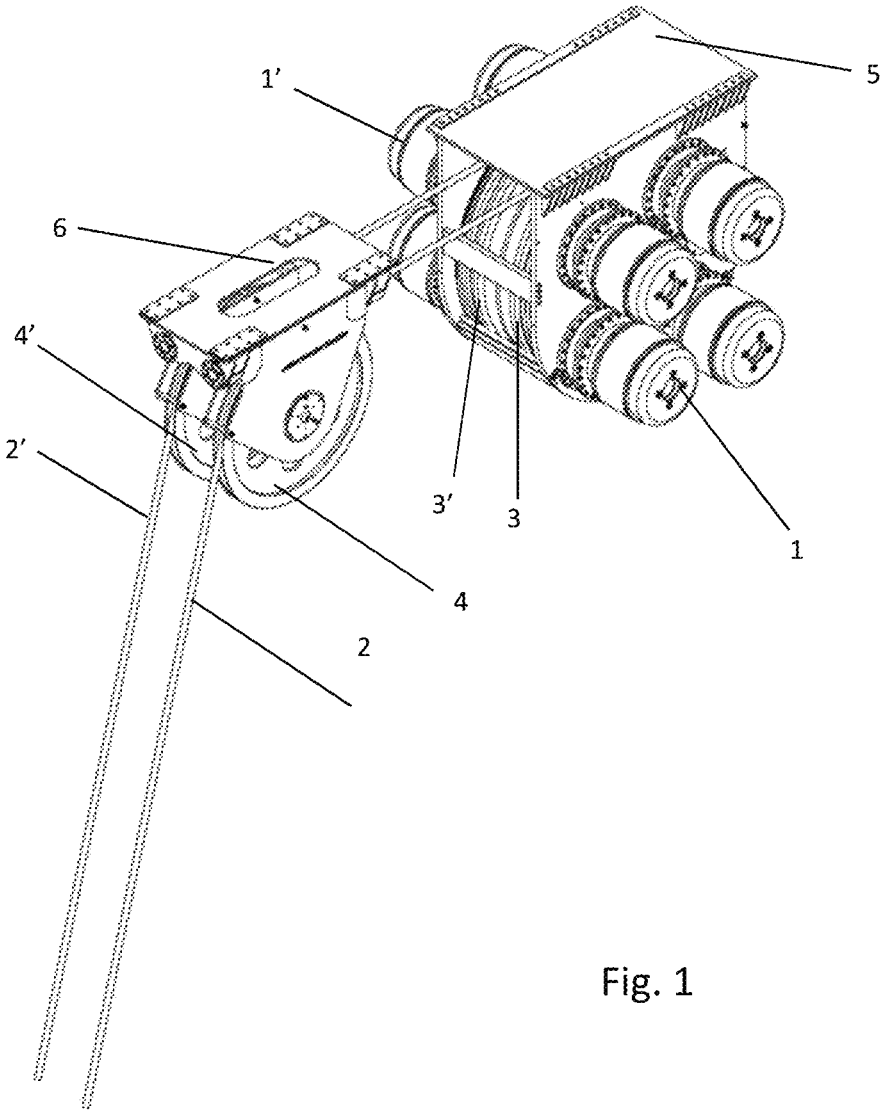
FIG. 1—Motor assembly with a sheave assembly
Figure 2A:
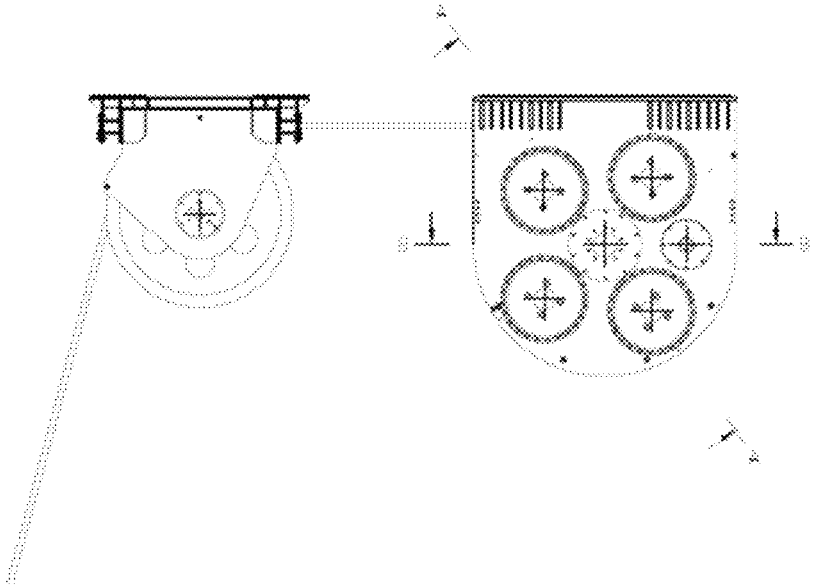
Figure 2B:
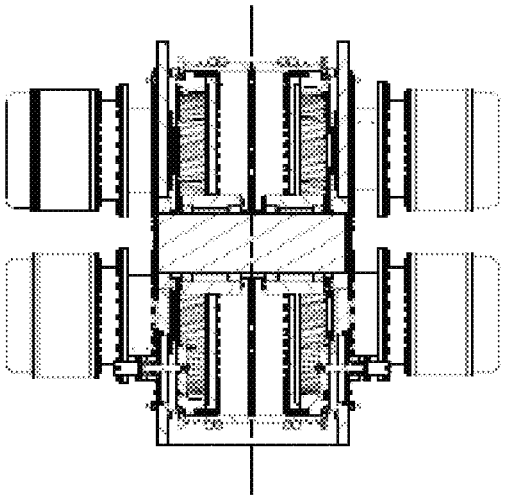
FIG. 2B—Cross section view B-B of FIG. 2A

The embodiments of the invention described here within is to be understood as examples of embodiments only, and the invention is not limited in its scope to the details of the following description or the illustrations made in the drawings and the flowcharts. The invention may be practiced and executed in various ways. The protection scope of the invention is defined by the associated independent claims, where advantageous embodiments are additionally defined by the dependent claims.

According to the present invention, there are several mechanisms involved in improving the flexibility, security and location of the riser tensioning system and or heave compensator system. The present invention is recognized in that all movable parts of the tensioning system are arranged under the drill floor; all pull forces are generated by motors, preferably digital hydraulic motors, and the tensioning system is therefore much less vulnerable to corrosion, wear and fatigue due to the environmental conditions. Additionally the tensioning system of the present invention occupies much less space on the drill floor to a point where the need for drill floor space is eliminated completely. A further advantage of the system is the flexibility and controllability of the tensioning system and or heave compensator system that now comprises an actuation force provided by a plurality of motors, preferably digital hydraulic motors. The system of the present invention may further comprise an electronic control unit for providing additional control of the motors, and the gas pressure force, distributed to the motors from the pressure reservoir via the phase separator in the accumulators, in the case where hydraulic motors are used.

It shall be understood that although the examples in this description are focused around the use of digital hydraulic motors and gas pressure reservoirs, some or all of the hydraulic motors can be substituted by electrical motors, and some or all gas pressure reservoir systems can be substituted by an electrical power reservoir system.

It shall also be understood that all features described in the various embodiments may, alone or in combination, apply or be used in connection with the other embodiments.

Specific terminology will be resorted to for the sake of clarity in the invention description and claims. It is to be understood that each specific term includes all technical equivalents which operate in a similar manner to accomplish a similar purpose.

Skidding/sliding frame—frame for mounting equipment that is to be moved from one location to another. The equipment is fixedly attached to the frame, and the frame is slidingly attached to the construction where the equipment is to be operated in different positions. Here the skidding/sliding frame is mounted to the underside of the platform floor to be able to move the riser tension system between well/operation centres.

Digital hydraulic motor—the pistons in digital pumps and motors maintain a constant stroke regardless of effective displacement. They accomplish both commutation and variable displacement by electronically controlling an inlet and outlet valve at each cylinder in a phased relationship to crankshaft position. Thus, a relatively simple and robust (for example: typically radial piston) machine with naturally low losses can be merged with a control system and high speed on-off valves to achieve better component level efficiency and controllability KERS—Energy recovery system: Kinetic Energy Recovery System shall in this document mean any system for recovering energy under braking or backstroke of the actuator in the motors and being stored in a power reservoir such as a battery, capacitor or for example a fly wheel, for later use.

Brake mode—A motor controlling the riser tensioning of a riser or the like in an offshore environment must be able to operate in a positive pull as well as a negative pull. A negative pull may be considered to be operating in a brake mode.

Reservoir—Any power reservoir, such as hydraulic accumulators, batteries, fly wheel, capacitors, etc.

Pressure reservoir—air/gas reservoir, hydraulic pressure reservoir,

Drill floor, floor, platform deck—Any offshore installation floor comprising equipment for drilling/exploring/production or other, typically the drill floor of a Floating Offshore Drilling vessel, Well intervention vessel and/or production vessel. Underlying structures, such as a cellar deck may be comprised in the definition.

Rig, drilling rig, platform—any Floating Offshore Drilling vessel, Well intervention vessel and/or production vessel typically having a derrick, tower, mast and/or turret.

BOP—blowout preventer

LMRP—lower marine riser package. The upper section of a subsea BOP stack consisting of a hydraulic connector, annular BOP, ball/flex joint, riser adapter, jumper hoses for the choke, kill, and auxiliary lines, and subsea control pods. The LMRP interfaces with the lower subsea BOP stack.

Wire rope spool direction—the direction of movement of the wire rope into or out of the wire drum.

Conventional motor—Any motor or motor assembly for use in marine operation.

When a digital hydraulic motor is used to describe embodiments in this description, it should be understood that the hydraulic digital motor can be substituted by an axial piston motor, an electric motor, or even a radial piston engine concept.

When the embodiments described in this description describes a tensioning system for a riser, it should be understood that the invention shall also comprise embodiments providing tension and/or heave compensation of guideline, podline, drillstring, or other downhole equipment in any offshore drilling environment where such tension and/or heave compensation is required.

Figure 4:
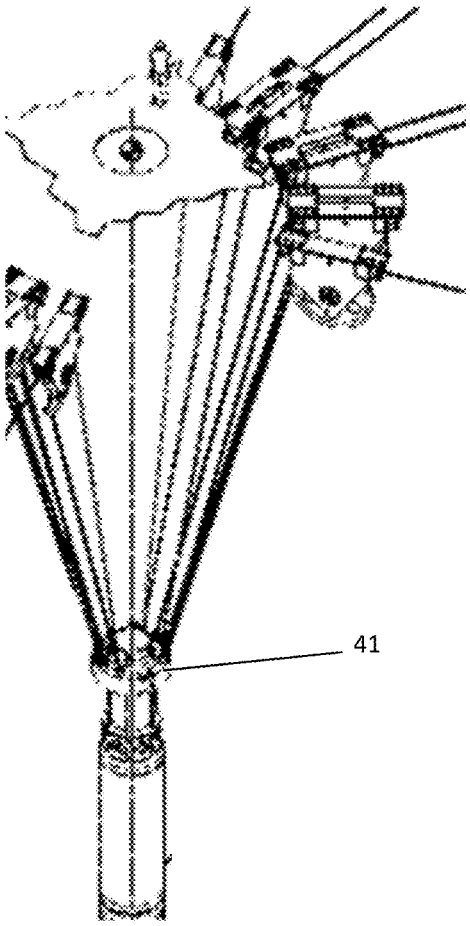
Figure 5:
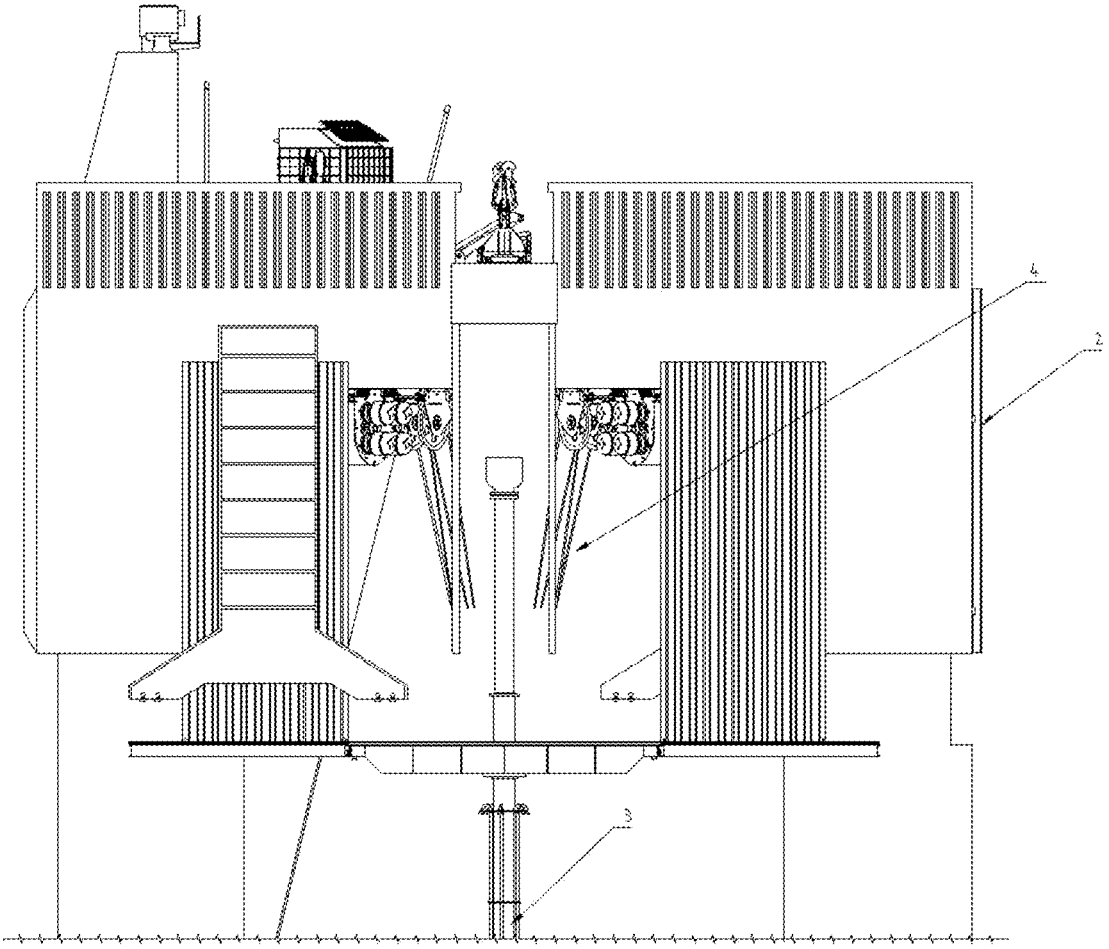

In one embodiment of the invention a motor assembly, as shown in FIG. 1, the motor assembly is comprised by a dual wire drum 3, 3', each driven/rotated by a plurality of motors 1, 1', and two wire ropes 2, 2' which in one end is fixed to and spooled onto the wire drum. The wire drums and the motors are mounted on a drum assembly bracket 5. In the embodiment shown in the figure the wire rope is guided over an optional wire sheave assembly 4, 4' and in the other end fixed to the riser tensioner ring 41 (see FIG. 4). The wire sheave assembly 4, 4' may be mounted to a sheave assembly bracket 6. Both the drum assembly bracket 5 and the wire sheave assembly bracket 6 may be mounted to the underside of the drill floor or to a skidding frame mounted to the underside of the drill floor. The motors 1, 1' may be individually controlled, and the rotation of the individual wire drum 3, 3' may be individually controlled.

FIG. 1 shows a dual motor-wire—drum assembly, although the invention may well use a single motor-wire-drum assembly where only one wire rope is spooled on a single drum. The motors may be arranged on one side of the drum or both sides of the drum (as shown in FIG. 1).

Figure 3A:
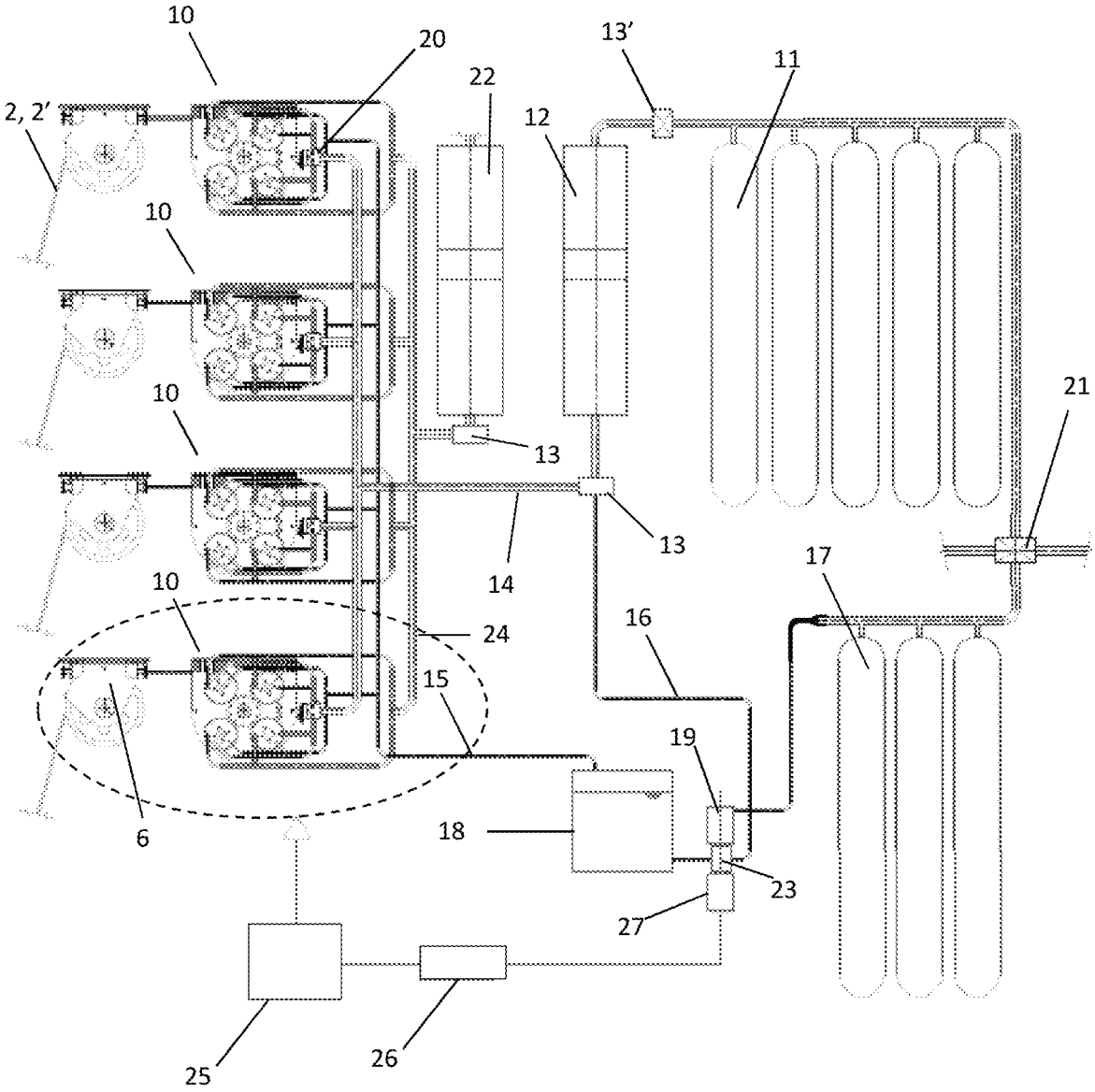
FIG. 3A—Riser tension system comprising a plurality of motor assemblies and a pressure reservoir FIG. 3B—section of motor assembly from FIG. 3A FIG. 4—Wire rope arrangement on riser tensioner ring FIG. 5—Production rig comprising a riser tensioning system of the invention FIG. 6—Simplified schematic of a Digital Pump/Motor Piston/Cylinder FIG. 7—Tension variations in a traditional tension compensation system v.s. present invention FIG. 8—Tension system based on electrical motors and battery FIG. 9A-9C—Winding modes of wire rope onto wire drum FIG. 10A-10B—show in the A figure a Traditional Derrick Hoisting system with Drawwork and Top Mounted Drillstring Compensator solved in a traditional manner and in the B figure the same tension functions are replaced using the present invention.
Figure 3B:
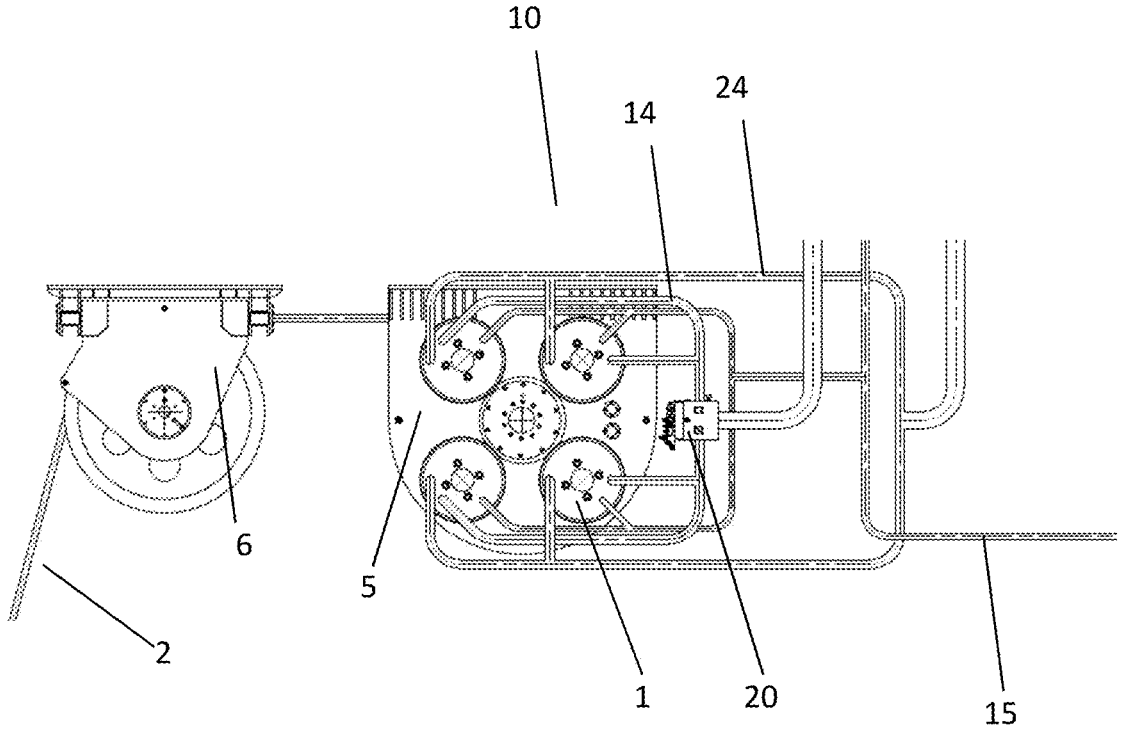

A plurality of motor assemblies as described above may be deployed in a riser tensioning system as outlined in FIG. 3A showing a system based on the use of digital hydraulic motors; where the system may comprise a high pressure gas reservoir 11, one or more high pressure accumulators 12, one or more low pressure accumulators 22, constant tension motor assemblies 10, wire ropes 2, 2', high pressure hydraulic fluid pipe system 14, low pressure hydraulic fluid pipe system 24, leakage fluid pipe system 15, tank for leakage fluid 18, leakage fluid pumps 23, and shut off valves 20, controlling valves 13 for controlling the fluid transport to and from the accumulators, and a controlling valve 13' for controlling the gas flow from the pressure reservoir, and a standby/backup pressurized pressure reservoir 17 and a pressure reservoir controlling valve 19 for supplying pneumatic motor 23 with power to pump leakage fluid from reservoir 18 back to high pressure hydraulic pipe system 14. Additionally a valve and pipe access may be provided through valve 21 for providing a pressure input typically engaged by a compressor for either increase or decrease of the gas pressure either in the high pressure reservoir 11, or the standby pressurized reservoir 17.

Figure 6:
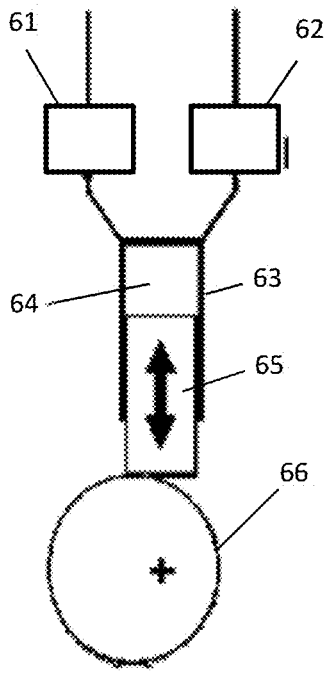

Each motor comprises a number of cylinders 63 as depicted in FIG. 6, were all cylinders volumes are coupled to the high pressure accumulator 12 via the high pressure hydraulic pipe system 14, and where the high pressure fluid passage into the individual cylinder 63 is controlled by a high pressure valve 61. All cylinders are further coupled to the low pressure accumulator 22 via the low pressure hydraulic pipe system 24, and where the low pressure fluid passage into the individual cylinder is controlled by a low pressure valve 62.

The low pressure accumulator 22 have a prefilled gas reservoir above the fluid/gas interface which may be controlled by a backup gas reservoir (not shown) for providing a slight biased pressure in the gas volume.

The cylinder valves 61, 62, high pressure and low pressure, operation is individually controlled for each cylinder 63. The two valves for each cylinder are mutual exclusive in that when high pressure valve is closed the low pressure valve is open, and when the high pressure valve is open, the low pressure valve is closed.

Each cylinder 63 may be in an active motor state, active pump state or in a passive state. When in an active motor state, such as on a falling heave flank, the high pressure valve is opened to apply torque power to the motor crank shaft 66 when cylinder piston rod 65 is in position for applying force to the rotating crank shaft 66. The total power applied to the crank shaft of each individual motor is the sum of the contribution of each individual cylinder being in an active motor state. When in the active motor state, the hydraulic fluid displacement in the motor piston generates a rotating moment and transfers fluid from the high pressure fluid pipe system 14 to the low pressure fluid pipe system 24, and by this active displacement increases the reservoir in the low pressure accumulator 22.

When the cylinder is in an active pump state, during spooling/reeling/pulling in the wire rope (such as on a rising heave flank), the high pressure valve 61 is open and the motor crank shaft 66 is applying a force to the piston rod and piston 65 in a reverse manner to increase the hydraulic fluid pressure above the piston head 64 in the cylinder 63 and the piston displacement pushes the fluid back into the high pressure hydraulic pipe system 14 and accumulator 12. When the crank shaft is rotating in this state, the low pressure valve 62 is opened when piston 65 is pulled down in the cylinder 63, this cylinder displacement is then filled with hydraulic fluid from pipe system 24 and accumulator 22, and when the cylinder movement turns and valve 62 closes the cylinder displacement pushes the fluid out through the high pressure valve 61 into the high pressure pipe system 14. In this state the cylinder 63 will represent a resistance force against the movement of the crank shaft 66 generated by the active cylinder area and the pressure in the high pressure pipe system 14. The number of cylinders 63 engaged in the pump action decides the total resistance force of the pump action of the motor 1. The active area of the engaged cylinders 63 in combination with the pressure in the high pressure accumulator determine the resistance force from the motor/pump action. When in the active pump state, the hydraulic fluid is flowing from the low pressure fluid pipe system 24 to the high pressure fluid pipe system 14, and increase the reservoir in the high pressure accumulator 12.

When the cylinder is in a passive state, the high pressure valve 61 is shut and the low pressure valve 62 is open all the time. The cylinder piston 65 will then passively follow the movement if the piston shaft which is connected to the motor crank shaft 66. Hydraulic fluid in the cylinder volume communicates all the time with the fluid in the low pressure pipe system 24. When in the passive state, the hydraulic fluid is flowing in and out of the low pressure valve 62, and the transfer of hydraulic fluid between the low pressure and high pressure side pipe systems are zero.

The high pressure pipe system of all the motors of a motor assembly may be coupled together in one high pressure pipe system 14.

The low pressure pipe system of all the motors of a motor assembly may be coupled together in one low pressure pipe system 24.

The high pressure pipe system 14 of all the motor assemblies 10 in a riser tension system may be coupled together in one high pressure pipe system 14.

The low pressure pipe system 24 of all the motor assemblies 10 in a riser tension system may be coupled together in one low pressure pipe system 24.

Each motor assembly of the present invention may be facilitated with one or more flow shutoff valves 20. The flow shutoff valve is activated in emergency situations when the motor assembly detects an uncontrolled spooling of the wire rope, i.e. if the wire rope breaks it is important in such situations to stop the cylinders to pull in the wire rope, and avoid filling up the low pressure reservoir in the low pressure accumulator 22. The flow shutoff valve may be designed to have a reaction time in the ms range from detection of alarming speed on the motor until the valve has shut off all fluid communication between pressure accumulators 12, 22 and the cylinders in the motors.

The flow shutoff valve may be mounted in the connection point for the high pressure pipe manifold, the low pressure pipe manifold or both. Alternatively can each cylinder pipe be controlled by an individual flow shutoff valve, in the high pressure pipe, the low pressure pipe or both.

During a normal disconnect from the well head and in the more rare occasion when the riser must be disconnected from the wellhead, which might happen if the Floating Offshore Drilling vessel, Well intervention vessel and/or production vessel drifts off or drive off the location (might happen typically if the vessel is a ship which rely solely on navigation DP) and the riser must be cut or detached. In traditional riser tension systems it is a challenge to adjust the pressure and tensioner capacity quickly enough to avoid damaging parts of the riser string and also a bounce back of the lower end of the riser, and thus, risk damage by hitting the bottom structure due to heave movement. The present invention may very quickly adjust motor displacement and active area, and adjust this to an optimal pull in order to safely lift the riser away from the seafloor installations and the seafloor itself as optimal as possible.

The tensioning system further comprises a control unit 25 for control of the setting of the valves and the pistons in the motors 1. The control unit may be set up to operate autonomously in accordance with a preset operation modus, or it may cooperate with a control room facility either onboard or remote. In the latter case the control unit also comprises communication means. In another embodiment the system comprise a battery backup 26. Battery backup 26 is used to maintain pump 27 activity on power black outs. Further features comprised in the tensioning system may be sensors and monitoring devices for monitoring pressure in the various pipe systems, temperatures of fluids, environmental conditions, motor positions, individual piston position, piston settings, wire rope 2, 2' position (length) and speed of reeling.

Figure 7:
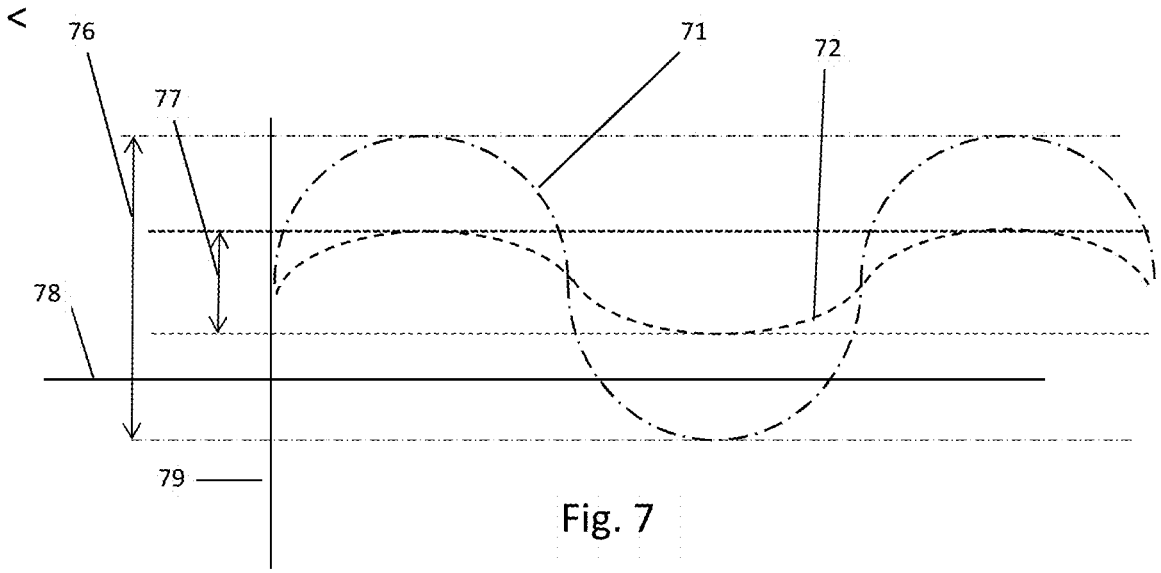

In FIG. 7 is an illustration of variations in pressure in the high pressure fluid circuit that need to be compensated by the accumulators of a traditional tension system 71, vs. that of the present invention 72. In a traditional system the actuators active area has to be designed to meet with the maximum needed capacity of the actuator system based on the maximum system pressure suitable for a given maximum pre-tensioning of the system. With the present invention it is provided the possibility to activate the required amount of active area (number of active cylinders in the motors) for a best possible performance curve for the actual load from the actuator based on the actual pre-tension setting and actual system pressure. By doing this with a digital valve setup on a fixed displacement radial piston motor it is still possible to maintain a close to zero leakage setup and also optimize the active area ratio based on the needed tension force from the overall actuator system. Because the active area and displacement volume of the number of pistons that are active can be controlled and adapted to each instantaneous situation, and since the forces that need to be applied vary, the area of the pistons is optimized and hence less fluid volume need to be deployed.

In a traditional system an actuator will at all time be exposing the same area of piston and piston rod for controlling the motion of the actuator, and it is not possible to adjust active actuator area to meet with actual needed tension force. Meaning all area must be exposed to the high pressure fluid circuit and the high pressure accumulators during the complete wave cycle. This requires considerable more volume in the accumulators to compensate for the same variations, i.e. due to heave. The same applies to the stand-by APV system that needs to be available for adjustment e.g. to various water depth levels, mud weights, offset etc. Using the motor assembly of the invention for a best possible optimization of the pre-tension setting and load variation will require considerable less reserve accumulators needed to be available at all time.

The digital hydraulic motors of the present invention enable accurate measurement of motor position and speed of wire rope in and out of the wire drum. The further accurate control of active cylinders in the hydraulic motor(s) deployed at any time in the tension control of the riser enables the present invention to offer superior features when experiencing wire rope breakage and emergency disconnect.

Figure 8:
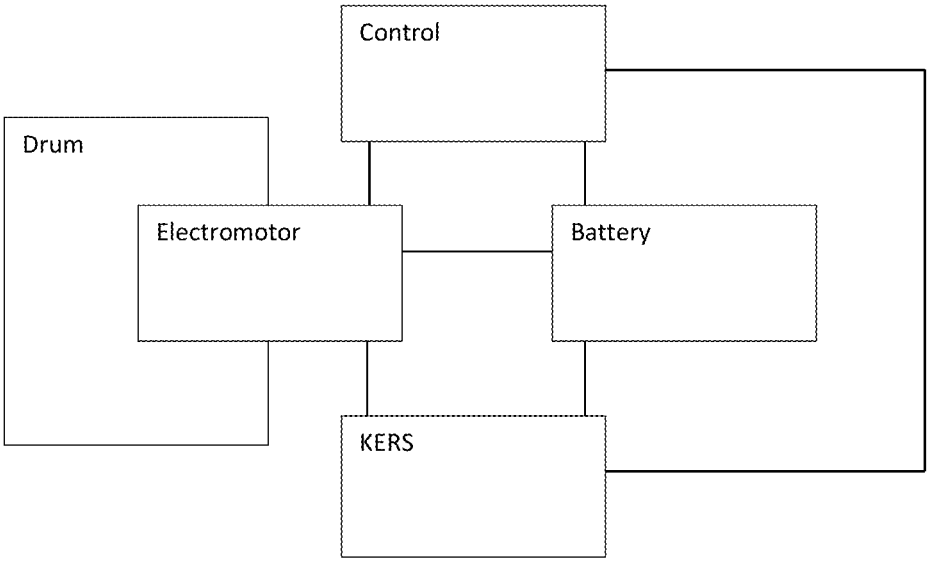

FIG. 8 is a block diagram showing the main part of a tension system based on motor assemblies comprising only electro motors. The system energy source is shown as a battery, but could be any other source of electrical power. Optionally the system comprise a energy recovery feature such as here depicted, a KERS module.

The electro motor assembly may also comprise a control module or feature as described above for the pneumatic systems.

Figure 9A:
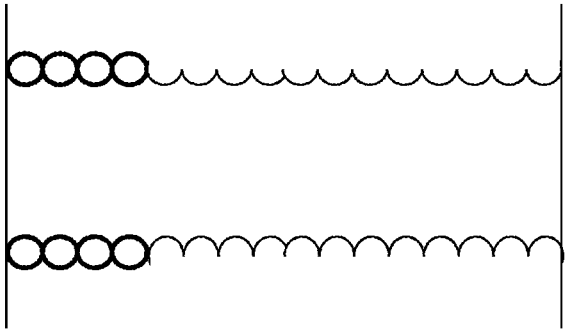
Figure 9B:
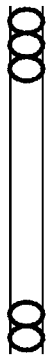
Figure 9C:
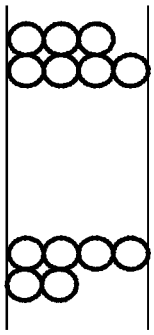

Alternative methods for winding the wire rope on the wire drum are illustrated in FIG. 9A-C. The wire rope can be winded in a single layer-multi file extending transversally to the wire feeding direction as shown in FIG. 9A. Optionally can the wire drum be formatted to encompass the wire rope, here seen as half spheres, at the size of the diameter of the wire rope, concave pattern in the wire drum body.

The wire rope can also be reeled in a single file-multi layer way, where the width between the wire drum walls are spaced with approximately the wire rope diameter width apart, as depicted in FIG. 9B.

A further method for winding is to provide a multi layer-multi file, as depicted in FIG. 9C.

In the following some further embodiments of the invention is discussed where the tension compensation is adapted to various operation in offshore drilling scenarios. The present invention can as described below be arranged to provide heave compensation of any downhole or guideline/podline operation, for example a drill string operation, providing heave compensation to the drill string. Such embodiments will typically substitute the heave compensation operation from a cylinder heave compensator system to a Digital Hydraulic and/or Electrical Motor Deadline/Winch Heave Compensator in the position of the traditional deadline anchor position. The advantage is a much simpler construction with lower center of gravity, COG, and improved compensator performance.

Figure 10A:
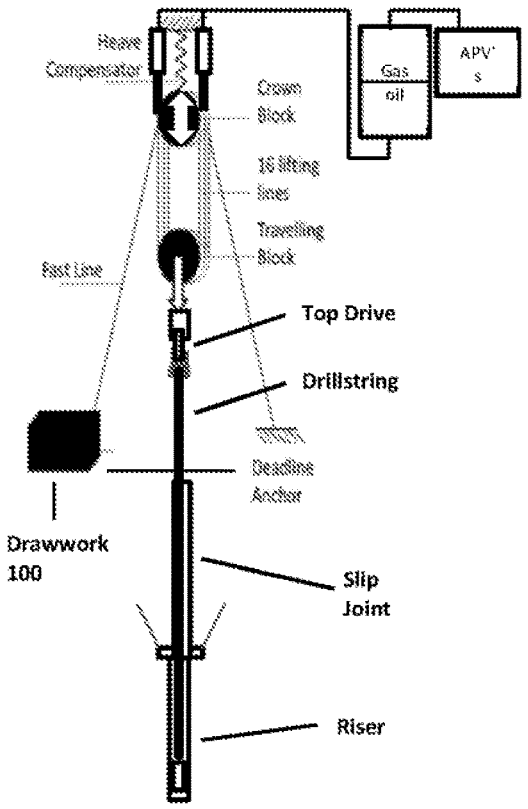
Fig. 10A Prior Art
Figure 10B:
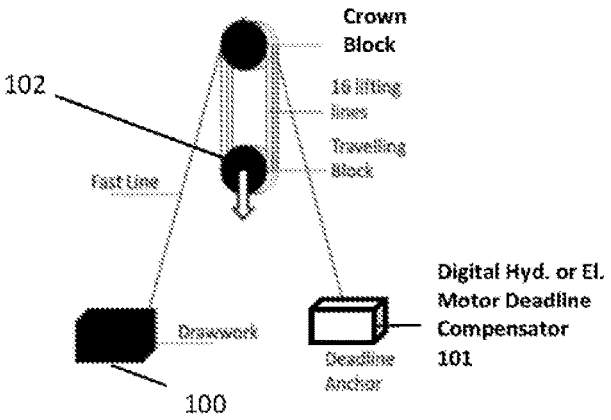

FIG. 10A describes a traditional derrick hoisting system with drawwork and top mounted drillstring compensator, and in FIG. 10B, the crown block heave compensator is replaced by a static crown block, and further a digital hydraulic, hydraulic or electrical motor deadline compensator (DLC) of the invention substituting the deadline anchor. In this embodiment the digital hydraulic, hydraulic or electrical motor deadline compensator eliminates the need for a top mounted heave compensator or active drawwork. The solution requires much lower COG (Centre of Gravity). The solution in FIG. 10B comprising the present invention further provides the improved performances as discussed above, comprising features such as need for less APV volume, and further a much simpler cut & slip operation when required.

Figure 11A:
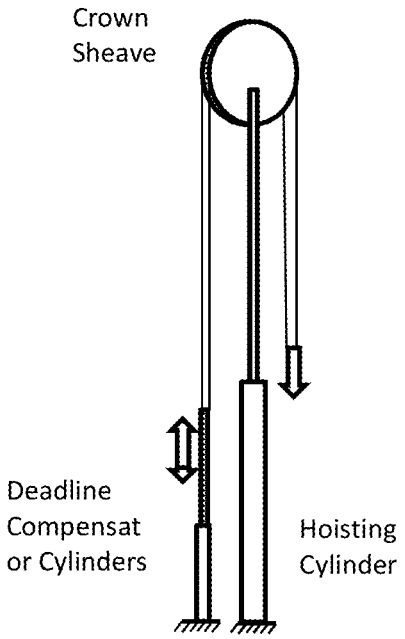
FIG. 11A-11B—show in the A figure a Traditional Cylinder Hoisting Rig system with Deadline Compensator and in the B figure the same tension functions are replaced using the present invention.
Figure 11B:
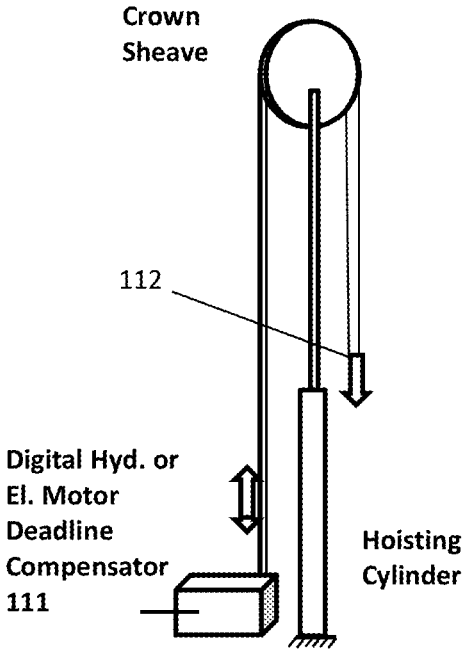

In FIG. 11A there is described an embodiment in a traditional cylinder hoisting rig system with deadline compensator setting, where the deadline compensator cylinders are substituted by the digital hydraulic, hydraulic or electrical motor deadline compensator of the invention in FIG. 11B. The system in FIG. 11B comprising the present invention eliminates the need for cylinder based DLC, it further improves the performance of the compensator function, by requiring less APV volume and providing a simpler cut &slip operation when required.

Figure 12A:
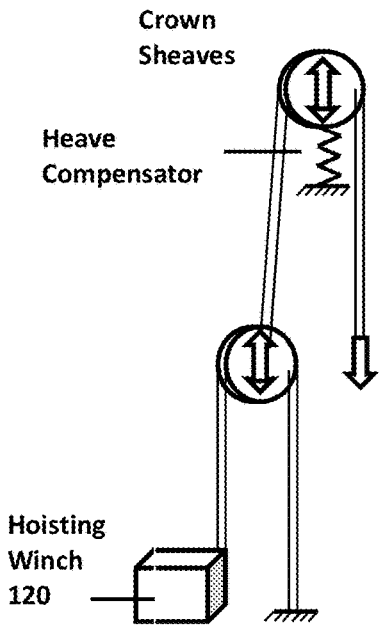
FIG. 12A-12B—show in the A figure a Single layer Hoisting System solved in a traditional manner and in the B figure the same tension functions are replaced using the present invention.
Figure 12B:
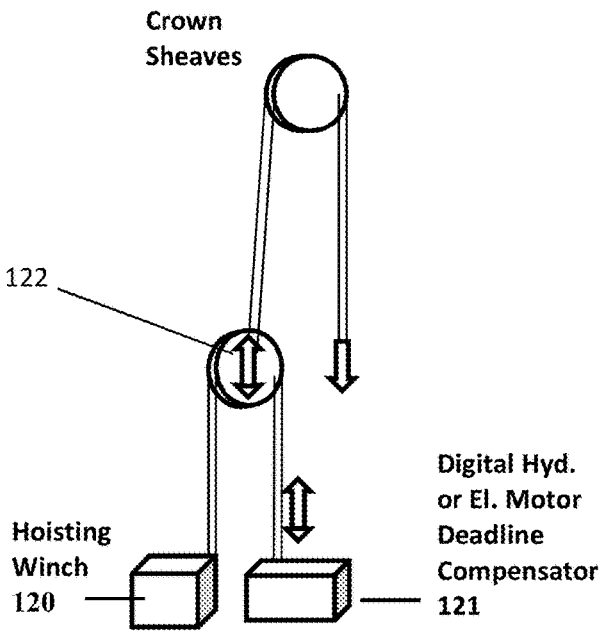

In FIG. 12A there is described an embodiment in a Hoisting System with top mounted compensator setting, where the crown block heave compensator is replaced by a static crown block, and further a digital hydraulic, hydraulic or electrical motor deadline compensator of the invention substituting the deadline anchor as shown in FIG. 12B. In this embodiment the digital hydraulic, hydraulic or electrical motor deadline compensator eliminates the need for a top mounted heave compensator. The system embodiment in FIG. 12B the digital hydraulic, hydraulic or electrical motor deadline compensator eliminates the need for a top mounted heave compensator. The solution requires much lower COG (Center of Gravity). The solution in FIG. 12B comprising the present invention further provides the improved performances as discussed above, comprising features such as need for less APV volume.

Figure 13A:
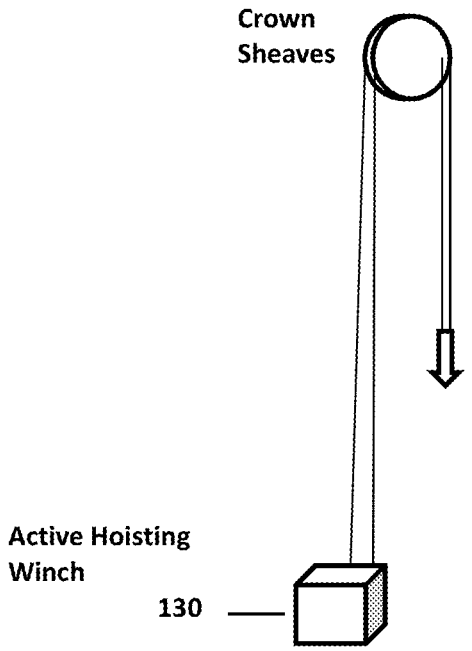
FIG. 13A-13B—show in the A figure a Balanced Hoisting Tower with active Compensator Winch System solved in a traditional manner and in the B figure the same tension functions are replaced using the present invention.
Figure 13B:
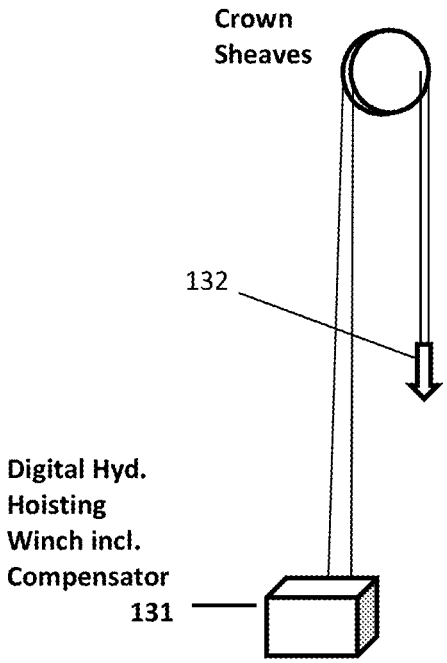

In FIG. 13A there is described an embodiment in a balanced hoisting tower with integrated jigger compensator winch system, where the active hoisting winch are substituted by the digital hydraulic, hydraulic or electrical motor hoisting winch including a compensator of the invention in FIG. 13B. The system in FIG. 13B comprising the present invention eliminates the need for cylinder based DLC, it further improves the performance of the compensator function, by requiring less APV volume.

Figure 14A:
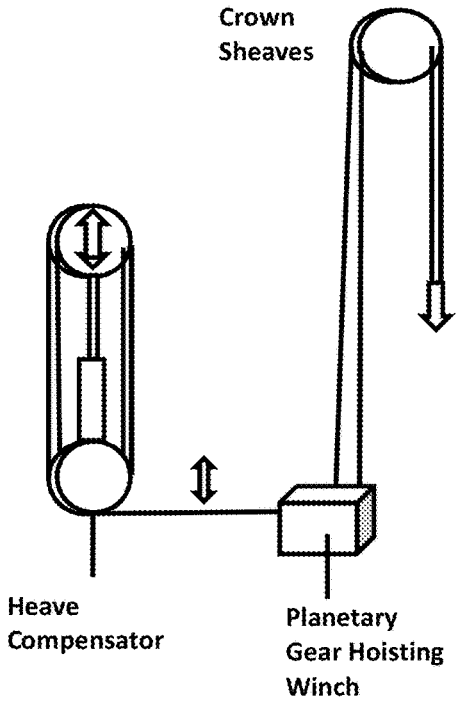
FIG. 14A-14B—show in the A figure a Planetary Gear Hoisting/Compensator System solved in a traditional manner and in the B figure the same tension functions are replaced using the present invention.
Figure 14B:
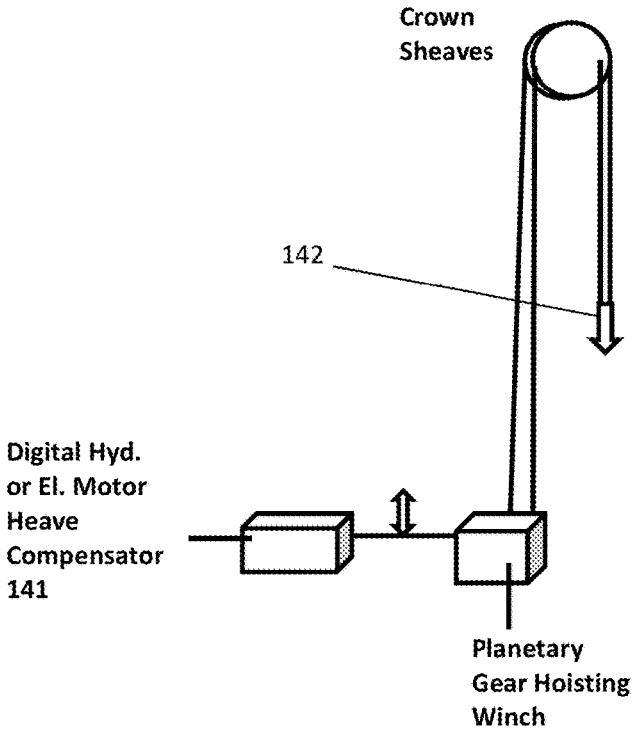

In FIG. 14A there is described an embodiment in a planetary gear hoisting/compensator system, where the heave compensator cylinders are substituted by the digital hydraulic, hydraulic or electrical motor heave compensator of the invention in FIG. 14B. The system in FIG. 14B comprising the present invention eliminates the need for cylinder based heave compensator, it further improves the performance of the compensator function, by requiring less APV volume.

Figure 15A:
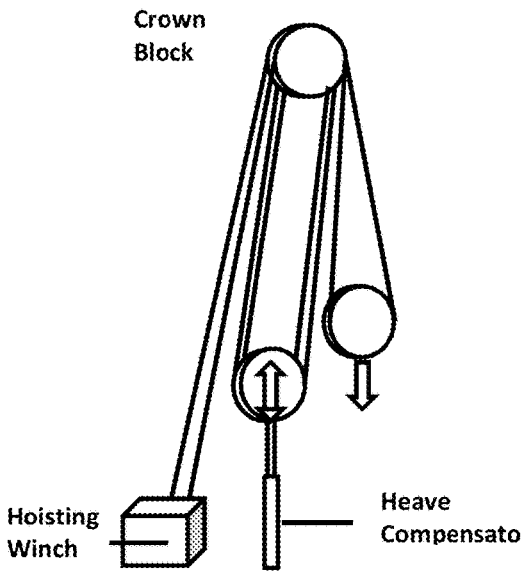
FIG. 15A-15B—show in the A figure a proposed Concept Hoisting System solved in a traditional manner and in the B figure the same tension functions are replaced using the present invention.
Figure 15B:
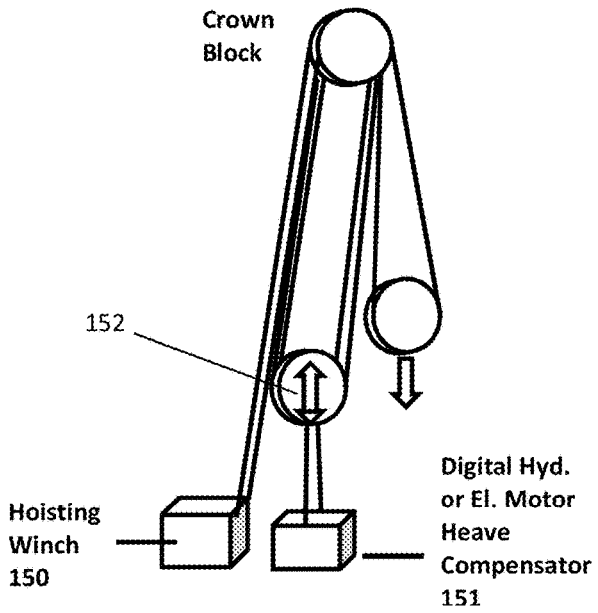

In FIG. 15A there is described an embodiment in a proposed concept hoisting system, where the heave compensator cylinders are substituted by the digital hydraulic, hydraulic or electrical motor heave compensator of the invention in FIG. 15B. The system in FIG. 15B comprising the present invention eliminates the need for cylinder based heave compensator, it further improves the performance of the compensator function, by requiring less APV volume.

Figure 16A:
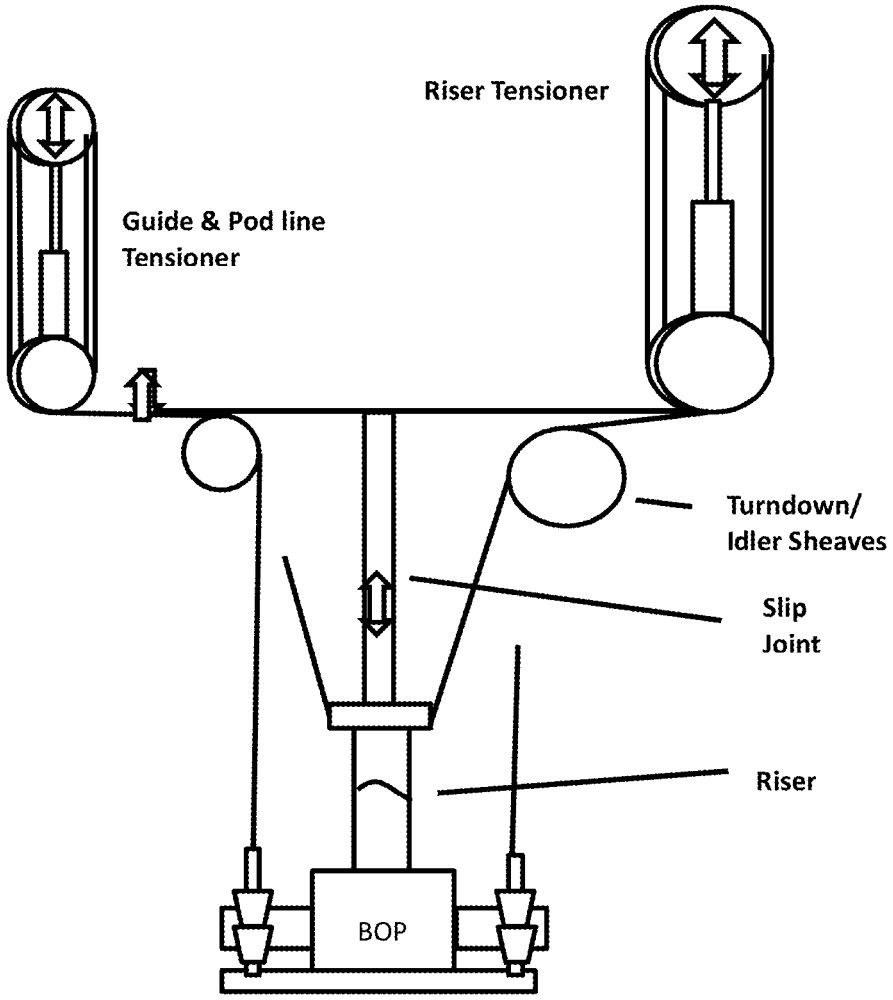
FIG. 16A-16B—show in the A figure a Riser Tensioner and Guide-/Podline tensioner system solved in a traditional manner and in the B figure the same tension functions are replaced using the present invention.
Figure 16B:
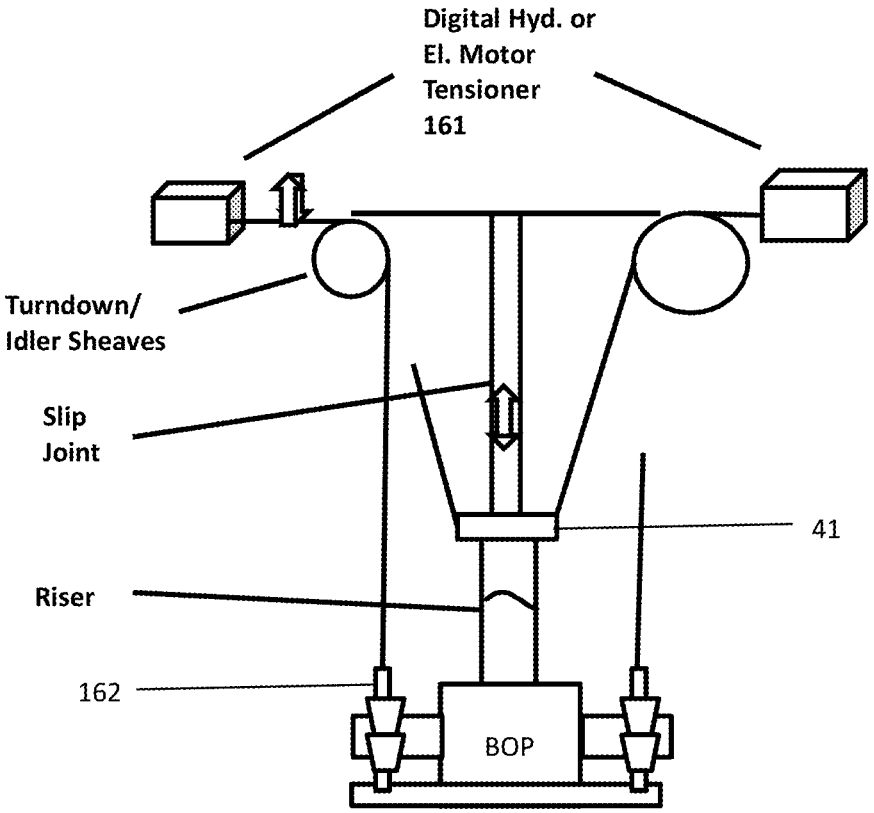

In FIG. 16A there is described an embodiment in a traditional riser tensioner and guide-/podline tensioner system, where both the Guide & Pod line Tensioner cylinders and riser tensioner cylinders are substituted by digital hydraulic, hydraulic or electrical motor heave compensators of the invention in FIG. 16B. The system in FIG. 16B comprising the present invention eliminates the need for cylinder based heave and tension compensators, it further improves the performance of the compensator function, by requiring less APV volume and providing a much simpler cut &slip operation when required.

Figure 17:
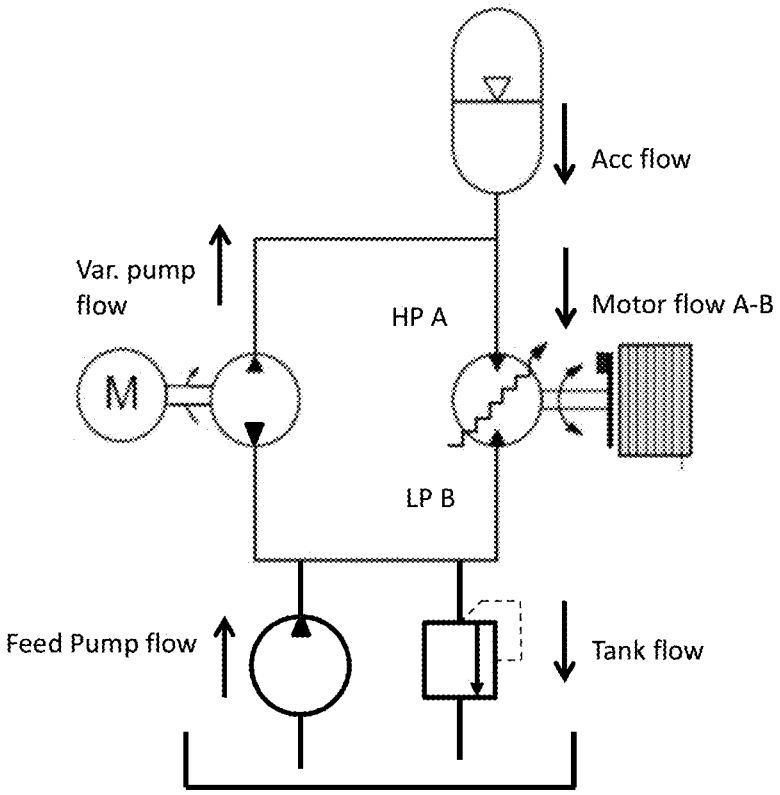
FIG. 17 illustrates a power/flow overview in a lifting drill string scenario

In FIG. 17 there is described a typical digital hydraulic hoisting diagram for regeneration of energy. The arrows show fluid direction in what could be a tripping out scenario lifting a drill string. The motor force is defined by the pressure generated by the Var. pump and Acc flow, HP A minus the LP B, Feed Pump flow.

It shall be possible, within the scope of the invention, to assemble a tensioning or heave compensator system as discussed in the embodiments above by using a combination of the various types of motor types discussed in each case. Any of the embodiments and variations discussed may therefore comprise only one of or a combination of motor types of the types discussed above. That said, it is also within the scope of the invention to provide the corresponding energy sources, such as accumulators, batteries, capacitors and the like, required by the individual motor type.

A first embodiment of the invention is further defined to comprise a tensioning or heave compensator system for an offshore drilling or production operation comprising at least one motor assembly; the motor assembly (10) comprising: at least one motor (1, 1'); a drum assembly bracket (5); at least one wire drum (3, 3'); at least one wire rope (2, 2'), the at least one wire rope having a first end which is fixedly attached to the wire drum (3) of the motor assembly (10, 101, 111, 121, 131, 141, 151, 161), and a second end attached to a tensioning or heave compensator object (41, 102, 112, 122, 132, 142, 152, 162) or drawwork (100, 120, 140); and the at least one motor (1,1') being coupled to the at least one wire drum (3, 3') via a gear assembly.

A second embodiment of the invention comprise a tensioning or heave compensator system for an offshore drilling or production operation according to the first embodiment, wherein the motor assembly is mounted to a drill floor or underside of a drill floor.

A third embodiment of the invention comprise a tensioning or heave compensator system for an offshore drilling or production operation according to the first or second embodiment, wherein the motor (1, 1') is a hydraulic motor.

A fourth embodiment of the invention comprise a tensioning or heave compensator system for an offshore drilling or production operation according to the third embodiment, wherein the riser tensioning system further comprise: a high pressure gas reservoir (11), at least one high pressure accumulator (12), a backup pressurized gas reservoir (17), a high pressure fluid pipe system (14), a leakage fluid pipe system (15), a leak fluid tank (18), shut off valves (20) and flow control valves (13, 13', 17',61, 62), and a pump (27) for pumping leakage fluid back into the high pressure pipe system (14).

A fifth embodiment of the invention comprise the tensioning system of any of the previous embodiments, wherein the motor (1, 1') is a digital hydraulic motor.

A sixth embodiment of the invention comprise the tensioning system of any of the previous embodiments, wherein the riser tensioning system further comprise at least one low pressure accumulator (22), and
a low pressure fluid pipe system (24).

A seventh embodiment of the invention comprise the tensioning system according to the first or second embodiment, wherein the motor (1, 1') is an electric motor.

An eight embodiment of the invention comprise the tensioning system according to the seventh embodiment, wherein the riser tensioning system further comprise a battery system for generating and storing power for driving the at least one motor.

An ninth embodiment of the invention comprise the tensioning system according to the eight embodiment, wherein the battery system further comprise an energy recovery system, KERS, for recovery of energy from the motors when platform rises due to heave.

A tenth embodiment of the invention comprise the tensioning system of any of the previous embodiments, wherein the at least one wire rope is spooled onto the wire drum in one of: single layer-multi file transverse to the wire rope spool direction, single file-multi layer, or multi file-multi layer way.

An eleventh embodiment of the invention comprise the tensioning system of any of the previous embodiments, wherein the riser tensioning system further comprising a control system for controlling the operation of the motors.

A twelfth embodiment of the invention comprise the tensioning system according to the eleventh embodiment, wherein the control system further comprising a communication device and a remote operating control input-output device.

A thirteenth embodiment of the invention comprise the tensioning system of any of the previous embodiments, wherein the at least one motor is mounted to a skidding frame, and the skidding frame is slidingly mounted on the underside of the platform floor.

A fourteenth embodiment of the invention comprise the tensioning system of any of the previous embodiments, wherein the tensioning system is a riser tensioning system.

A fifteenth embodiment of the invention comprise the tensioning system according to the fourteenth embodiment, wherein the system further comprising a wire sheave assembly (4, 4') mounted to the underside of the drill floor between the motor assembly (10) and the riser tension ring (41) for guiding the wire rope (2, 2').

A sixteenth embodiment of the invention comprise the tensioning system according to any of the previous first to thirteenth embodiments, wherein the tensioning system is a drillstring heave compensation system.

A seventeenth embodiment of the invention comprise the tensioning system according to any of the previous first to thirteenth embodiments, wherein the tensioning system is a guideline tensioning and heave compensation system.

An eighteenth embodiment of the invention comprise the tensioning system according to any of the previous first to thirteenth embodiments, wherein the tensioning system is a podline tensioning and heave compensation system.

A nineteenth embodiment of the invention comprise the tensioning system according to the seventeenth or eighteenth embodiment, wherein the system further comprising a wire sheave assembly (4, 4') mounted to the underside of the drill floor between the motor assembly (10) and the guideline anchor point (162) for guiding the wire rope (2, 2').

A first method embodiment of the invention is further defined to comprise a method for providing a tension or heave compensation in an offshore drilling or production operation wherein the method comprise of the following step of providing:

at least one motor assembly (10), mounted to a drill floor or underside of a drill floor, at least one wire rope (2, 2'), the at least one wire rope being fixedly attached in a first end to a wire drum (3,3') of the motor assembly (10, 101, 111, 121, 131, 141, 151, 161) being controlled by the motor assembly (10), and being attached in a second end to a tensioning or heave compensated object (41, 102, 112, 122, 132, 142, 152, 162) or drawwork (100, 120, 140); the method further comprising to:

applying a continuous tension to the wire rope compensating for pull and heave force variations to the tensioning or heave compensated object (41, 102, 112, 122, 132, 142, 152, 162) or drawwork (100, 120, 140); wherein the continuous tension being increased on falling heave flank and decreased on rising heave flank.

A second method embodiment according to the first method embodiment, wherein the at least one motor assembly is comprised of digital hydraulic motors, and the hydraulic pressure to the motors assemblies (10) are provided by a high pressure gas reservoir (11), at least one high pressure accumulator (12), a high pressure fluid pipe system (14), and at least one low pressure accumulator (22), and a low pressure fluid pipe system (24).

A third method embodiment according to the first method embodiment, wherein the at least one motor assembly is comprised of electric motors.

The invention claimed is:

1. A tensioning system for an offshore drilling or production operation, comprising:

at least one motor assembly comprising:

at least one digital hydraulic motor comprising a number of cylinders, wherein:

a volume of each cylinder is coupled to a high pressure accumulator via a high pressure hydraulic pipe system, a high pressure fluid passage into each cylinder is individually controlled by a high pressure valve, each cylinder is further coupled to a low pressure accumulator via a low pressure hydraulic pipe system, and a low pressure fluid passage into each cylinder is individual controlled by a low pressure valve;

wherein each cylinder has at least an active state and a passive state;

wherein a total power applied is defined by a respective number of cylinders being set in the active state, and the respective number of cylinders being set in active state are adapted at any time to a required applied power at any specific moment in time, and wherein a total capacity of the high pressure accumulator is correspondingly adapted to a maximum required hydraulic pressure at any specific given operation depth and load;

a drum assembly bracket;

at least one wire drum;

at least one wire rope having a first end which is fixedly attached to the wire drum of the motor assembly, and a second end attached to a tensioning object, wherein the tensioning object is attached to a subsea floor or subsea floor assembly; and wherein the at least one digitally hydraulic motor is coupled with the at least one wire drum via a gear assembly.

2. The tensioning system of claim 1, wherein the motor assembly is mounted to a drill floor or underside of a drill floor.

3. The tensioning system of claim 1, further comprising:

a high pressure gas reservoir, at least one high pressure accumulator, a backup pressurized gas reservoir, a high pressure fluid pipe system, a leakage fluid pipe system, a leak fluid tank, shut off valves and flow control valves, and a pump for pumping leakage fluid from the leak fluid tank back into the high pressure pipe system.

4. The tensioning system of claim 1, further comprising:

a low pressure fluid pipe system.

5. The tensioning system of claim 1, wherein the at least one motor assembly comprises one or more further motors, which include at least one electric motor.

6. The tensioning system of claim 5, further comprising a battery system for driving the at least one electric motor.

7. The tensioning system of claim 6, wherein the battery system further comprises:

an energy recovery system, KERS (Kinetic Energy Recovery System), for charging the battery system by recovery of energy from the motors under braking or backstroke of an actuator in the motors when a platform associated with the tensioning system rises due to heave.

8. The tensioning system of claim 1, wherein the at least one wire rope is spooled onto the wire drum in one of: a single layer-multi file transverse to the wire rope spool direction, single file-multi layer, or multi file-multi layer configuration.

9. The tensioning system of claim 1, further comprising a control system for controlling the operation of the motors.

10. The tensioning system of claim 9, wherein the control system further comprises a communication device and a remote operating control input-output device.

11. The tensioning system of claim 1, wherein the at least one motor is mounted to a skidding frame, and the skidding frame is slidingly mounted on the underside of a platform floor.

12. The tensioning system of claim 1, wherein the tensioning system is a riser tensioning system.

13. The tensioning system of claim 12, further comprising a wire sheave assembly mounted to an underside of a drill floor between the motor assembly and a riser tension ring for guiding the wire rope.

14. The tensioning system of claim 1, wherein the tensioning system is a guideline tensioning system.

15. The tensioning system of claim 14, further comprising a wire sheave assembly mounted to an underside of a drill floor between the motor assembly and a guideline anchor point for guiding the wire rope.

16. The tensioning system of claim 1, wherein the tensioning system is a podline tensioning system.

17. A method for providing a tension system in an offshore drilling or production operation, wherein the method comprises:

providing at least one motor assembly, wherein the motor assembly comprises at least one digital hydraulic motor mounted to a drill floor or underside of the drill floor;

providing at least one wire rope, the at least one wire rope being fixedly attached at a first end to a wire drum of the motor assembly, wherein the wire rope is controlled by the motor assembly, and attached at a second end to a tensioning object;

compensating for pull and heave force variations to the tensioning object by applying a continuous tension to the wire rope, wherein the continuous tension is increased on a falling heave flank and decreased on a rising heave flank; and providing hydraulic pressure to the at least one digitally hydraulic motor assembly by a high pressure gas reservoir, at least one high pressure accumulator, a high pressure fluid pipe system, at least one low pressure accumulator, and a low pressure fluid pipe system.

18. The method of claim 17, wherein the motor assembly comprises one or more further motors which are electric motors.

* * * * *